US005957772A

United States Patent [19]

Rutkowski et al.

[11] Patent Number: 5,957,772

[45] Date of Patent: Sep. 28, 1999

[54] FIRE RATED WALL DAMPER ASSEMBLY

[76] Inventors: Francis Rutkowski, 55 Patrick Dr., Manahawkin, N.J. 08050; Daniel Duff, 15 Tiller Dr., Barnegat, N.J. 08005

[21] Appl. No.: 09/062,622

[22] Filed: Apr. 20, 1998

[51] Int. Cl.[6] ..... A62C 2/06

[52] U.S. Cl. ..... 454/257; 454/369

[58] Field of Search ..... 454/357, 257, 454/342, 369, 330, 332, 331

[56] References Cited

U.S. PATENT DOCUMENTS

| | | | |
|---|---|---|---|
| 3,960,065 | 6/1976 | McCabe . | |
| 4,524,678 | 6/1985 | Klebanoff . | |
| 4,579,047 | 4/1986 | Zielinski . | |
| 4,754,696 | 7/1988 | Sarazen et al. . | |
| 4,815,364 | 3/1989 | Wagner et al. . | |
| 5,014,610 | 5/1991 | Twito . | |
| 5,338,255 | 8/1994 | Akehurst | 454/292 |

*Primary Examiner*—Harold Joyce
*Assistant Examiner*—Derek S. Boles
*Attorney, Agent, or Firm*—Charles I. Brodsky

[57] ABSTRACT

A fire damper having a surrounding frame positioned rearwardly of a register or grill diffuser within a construction wall installation is fixedly secured to a sleeve assembly having a rear surface aligned substantially co-linearly with the rear surface of the fire damper. In such manner, the rear surface of the sleeve assembly and the rear surface of the fire damper are constrained to rest substantially flat against the construction wall installation in a way so as to prevent the snaking around of flames to enter into ductwork within the wall in otherwise by-passing the fire damper protector.

7 Claims, 4 Drawing Sheets

FIRE RATED WALL DAMPER ASSEMBLY

FIELD OF THE INVENTION

This invention relates to fire dampers for sheet rock construction wall installations and, more particularly, to a fire rated wall damper which can be factory-manufactured to meet a variety of installation and fire code requirements.

BACKGROUND OF THE INVENTION

Fire dampers for meeting building and fire codes are well known. Typically, they allow air flow therethrough in normal conditions, but automatically close in the event of a temperature rise above a prescribed level during a fire, to block smoke, heat, and the fire itself from freely flowing through the ductwork in engulfing the building. Most often, dampers of this type are held in an open position by various kinds of heat responsive linkages, but which automatically snap shut under biasing forces of a spring(s) or gravity once the threshold temperature is exceeded. In such installations, the fire dampers of this type usually involve frame-mounted enclosures inserted directly into the various conduit systems in the building. To the front of the frame-mounted enclosure is a register or grill diffuser serving as a supply or an exhaust vent, either with or without the ability to regulate the volume of air flowing through it.

Although these types of fire dampers have been around for years, only with the recent adoption of more stringent building and fire codes has attention been directed to their ability to optimally perform during fire emergencies. For example, with the frame mounted enclosure seated directly into a conduit of the building, back from its overlying register or grill, an air space exists through which the fire can shoot, even before the flames reach the damper blades closed off by the action of the melting heat responsive, or bi-metallic linkage. Secondly, and were this not bad enough, a further problem exists where the depth dimension forming the shaft between the fire rated sheet-rock construction wall is insufficient to fully house the frame-mounted enclosure, so that the register or grill, along with the front of the damper frame extend inwardly of the room—a condition outside the requirements of the various building and fire codes which apply. And, even beyond that, the problem becomes even more magnified where the fire damper employs an opposed blade damper behind it, at its rear, in serving as a screw-driver adjustable air diffuser. Experience has shown that many times, where one even strives to comply with the building and fire codes to minimize these problems, efforts must be taken at the construction site itself to specially make, one-by-one, individual assemblies to meet the installation requirements, thereby increasing labor and manufacturing costs, in an arrangement that does not, and probably will not, obtain Underwriters Listing approval.

OBJECTS OF THE INVENTION

It is an object of the present invention, therefore, to provide a new and improved fire rated wall damper assembly that overcomes these limitations inherent in the prior art.

It is an object of the present invention, also, to provide such a fire rated wall damper assembly which can be factory manufactured in quantity, to meet any depth requirements encountered in the sheet-rock construction wall spacing in specifying building wall thicknesses.

It is another object of the present invention to provide such a fire rated wall damper assembly which can be oriented in both horizontal or vertical planes depending upon construction engineer design specifications for the building being erected, and from readily available materials.

It is yet a further object of the invention to provide such a fire rated wall damper assembly no matter what type of register, grill, fire damper, and opposed blade damper might be specified in the design phase for the structure being built.

SUMMARY OF THE INVENTION

As will become clear from the following description, the objectives of the invention are realized through the use of a flanged sleeve assembly which joins the fire damper and the register or grill being used in a manner so as to bring the frame mounted enclosure of the fire damper substantially flat against the construction wall installation, and in a manner where the flanged sleeve assembly is itself fire rated, as when constructed of at least a 22 gauge sheet metal. As will be described, the sleeve assembly incorporates a front surface to which the register or grill diffuser is coupled, along with a rear surface which is secured to the surrounding frame of the fire damper so as to be substantially co-linear therewith. In one preferred embodiment to be set forth, the front surface of the fire rated sleeve assembly receives such register or grill diffuser by means of a screw securement. There, the rear surface of the fire rated sleeve assembly is fixed to the surrounding frame of the fire damper enclosure by means of a rivet or similar type securement. With the dimensions of the fire rated sleeve assembly being such as to overlie the duct opening in the construction wall in which the fire damper is received, the preferred embodiment of the invention utilizes the flanged nature of the sleeve assembly so as to bring that assembly flat against the construction wall, so as to prevent any fire from snaking around it, and to flue up the shaft before reaching the closure mechanisms of the fire damper.

As will be appreciated by those skilled in the art, even with an adjustable opposed blade damper coupled to the rear of the fire damper in a wall space much less than the overall depth of such combination, the extension of the register or grill and the fire damper coupled to it into the room will be understood not to impair the overall fire rating as the heavy gauge sheet metal surrounding the fire damper, and substantially co-linear therewith, prevents any flames from melting the assembly and filtering into the ductwork shaft and/or ductwork. In this manner, and as will be seen, the flame preventing integrity of the fire damper is preserved intact.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
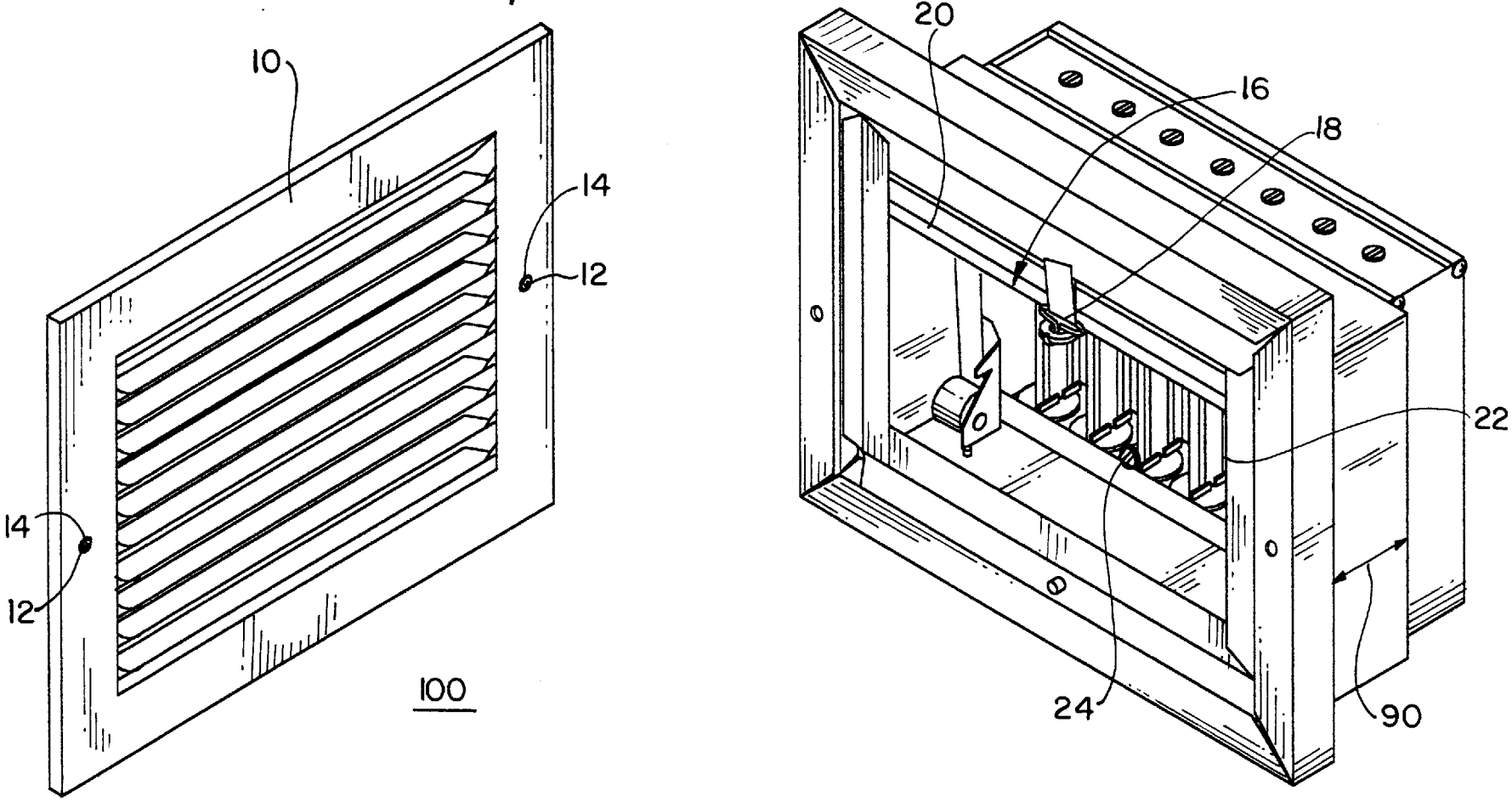
FIG. 1 is a front perspective view of a fire rated wall damper with its register or grill removed, constructed in accordance with the teachings of the present invention.

Referring to the drawings, a register or grill diffuser 10 is shown temporarily removed from the fire rated wall damper 100 of the invention to illustrate its inner construction, being thereafter secured by a pair of screws 12 through a pair of apertures 14. Any appropriate type of fire damper 100 may be overlain by the register or grill diffuser 10, and is illustratively shown in FIG. 1 as including a bi-metallic, heat responsive linkage 18, which when melting in the presence of temperatures beyond a prescribed level snaps shut to close off the fire damper 16 once a prescribed temperature threshold is exceeded. Under such circumstances, a stainless steel curtain 20 closes, under the action of a biasing spring or under gravity, for example, to close off the duct. Such a fire damper may be of the type manufactured by the Arlan Damper Corp., of a type approved by Underwriters Laboratories Inc. Behind the fire damper 16 is included an opposed blade damper 22 of any appropriate type, controllable in opening or closing by a convention screwdriver adjustment at 24 for regulating the volume of air flow into and from the connecting duct as desired—and once pre-set, generally remains at that placement. As will be appreciated, any type of register or grill diffuser 10 may be employed according to the invention, as well as any specific manufacture for the workings of the fire damper 16 and/or the opposed blade damper 22.

Figure 2:
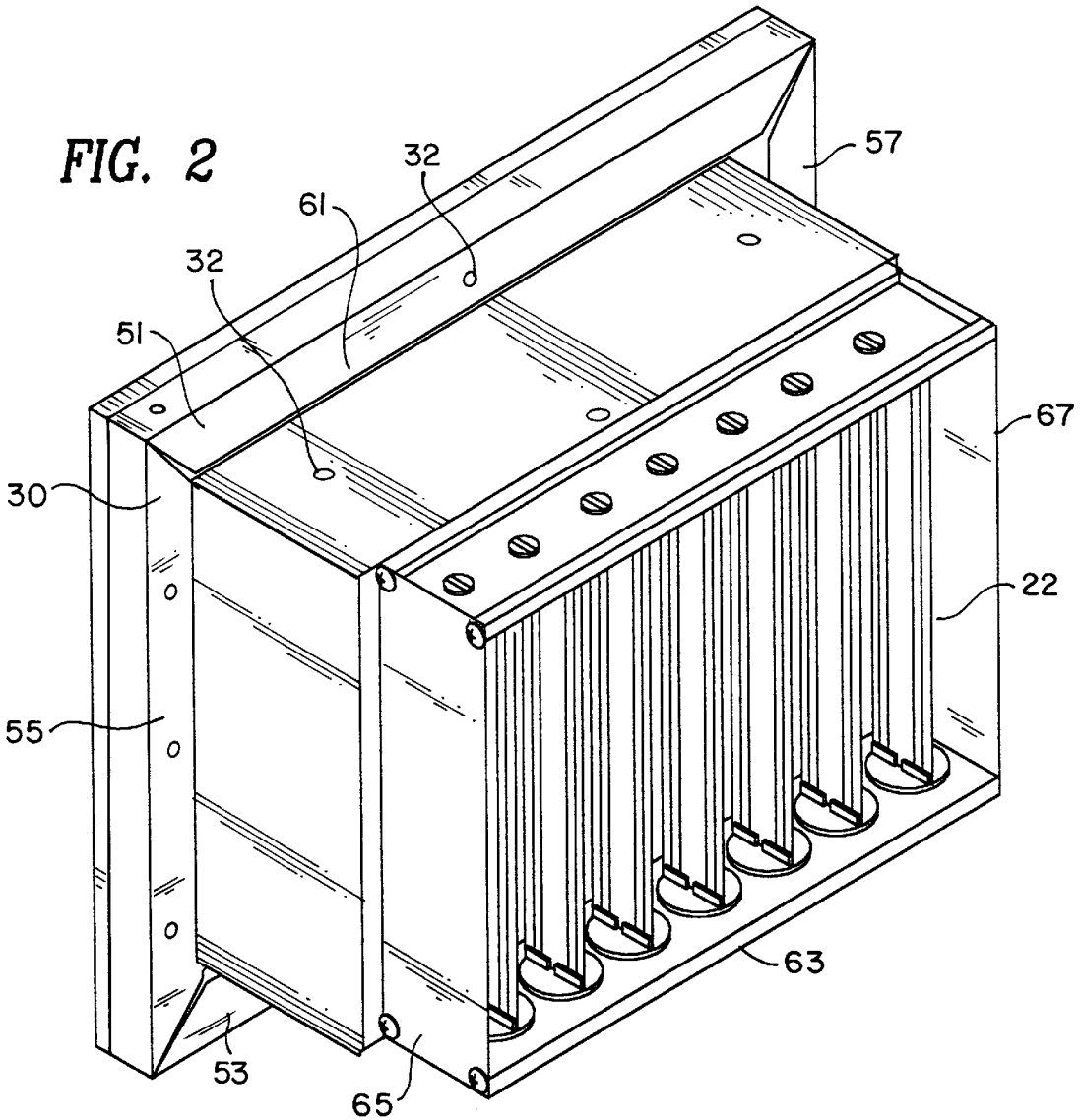
FIG. 2 is a rear perspective view of the fire rated wall damper of the invention.

As more particularly shown in FIG. 2, the fire damper 16 typically includes top, bottom and side wall flanges 51, 53, 55 and 57. Also shown in FIG. 2 is the sleeve assembly 30 of the invention, itself having top, bottom and side wall rear surfaces 61, 63, 65 and 67. As indicated, the top, bottom and side rear surfaces 61, 63, 65 and 67 of the sleeve assembly 30 overlie the top, bottom and side flange surfaces 51, 53, 55 and 57 of the fire damper 16, and are fixed thereto by means of a plurality of rivets 32 or similar fastening methods. In such manner, these rear surfaces of the sleeve assembly 30 secure to these surrounding frame surfaces of the fire damper 16 substantially co-linearly. Such rivets 32, along with their manner of joining to the assembly surfaces of the sleeve with the flange surfaces of the fire damper 16, is more clearly shown in FIG. 1. FIG. 1 also illustrates a depth for the sleeve assembly 30, as at 90, to receive a register therein, instead of the grill 10 of FIG. 1. As will be understood, such depth 90 serves to accommodate whatever register is employed—and not necessarily the ½"–⅝" selected in the preferred embodiment shown in the drawings. While such depth dimension 90 is not significant, the composition of the sleeve assembly 30 is quite relevant—and in accordance with the invention is of a composition to be fire rated, as constructed of at least a 22 gauge sheet metal which will not melt prior to the damper.

As will be appreciated by those skilled in the art, no matter how great the fire damper 16 and the sleeve assembly 30 of the invention thus extend into a room, the heavy gauge sheet metal of the fire damper 16 and the sleeve assembly 30 preserve their integrity in the presence of a fire condition. As will also be appreciated, by having the rear surfaces of the sleeve assembly at 61, 63, 65 and 67 co-linear with the flange surfaces 51, 53, 55, and 57, no real avenue exists for the flames to snake around or behind to flue up any air shaft or duct. By selecting the rear sleeve assembly surfaces 61, 63, 65 and 67 to be planar, furthermore, the sleeve assembly 30 of the invention is constrained to rest substantially flat against the construction wall whereat the fire damper 16 is installed, to likewise prevent any flames from getting around the assembly 30, into the ductwork. In essence, then, with the wall damper 100 of the invention, any flames that may be present are blocked from entering into the ductwork, except through the register or grill diffuser, where they are then cutoff by the conventional action of the fire damper 16 employed. And, in this manner, the fire rated wall damper 100 will be seen to provide its protection in operation no matter how narrow the wall space, and no matter how far the fire damper 16—register-grill diffuser 10 combination extend into a room, as the heavy gauge sheet metal of the sleeve assembly 30 and fire damper 16 continue unabated, able to withstand all foreseeable temperatures for a specified time. Thus, once the duct dimensions are established, the outer dimensions of the fire rated wall damper 100 are set, and the fire rated wall damper 100 can then be mass-produced in a factory setting generally regardless of what the wall space thickness might be.

Figure 3:
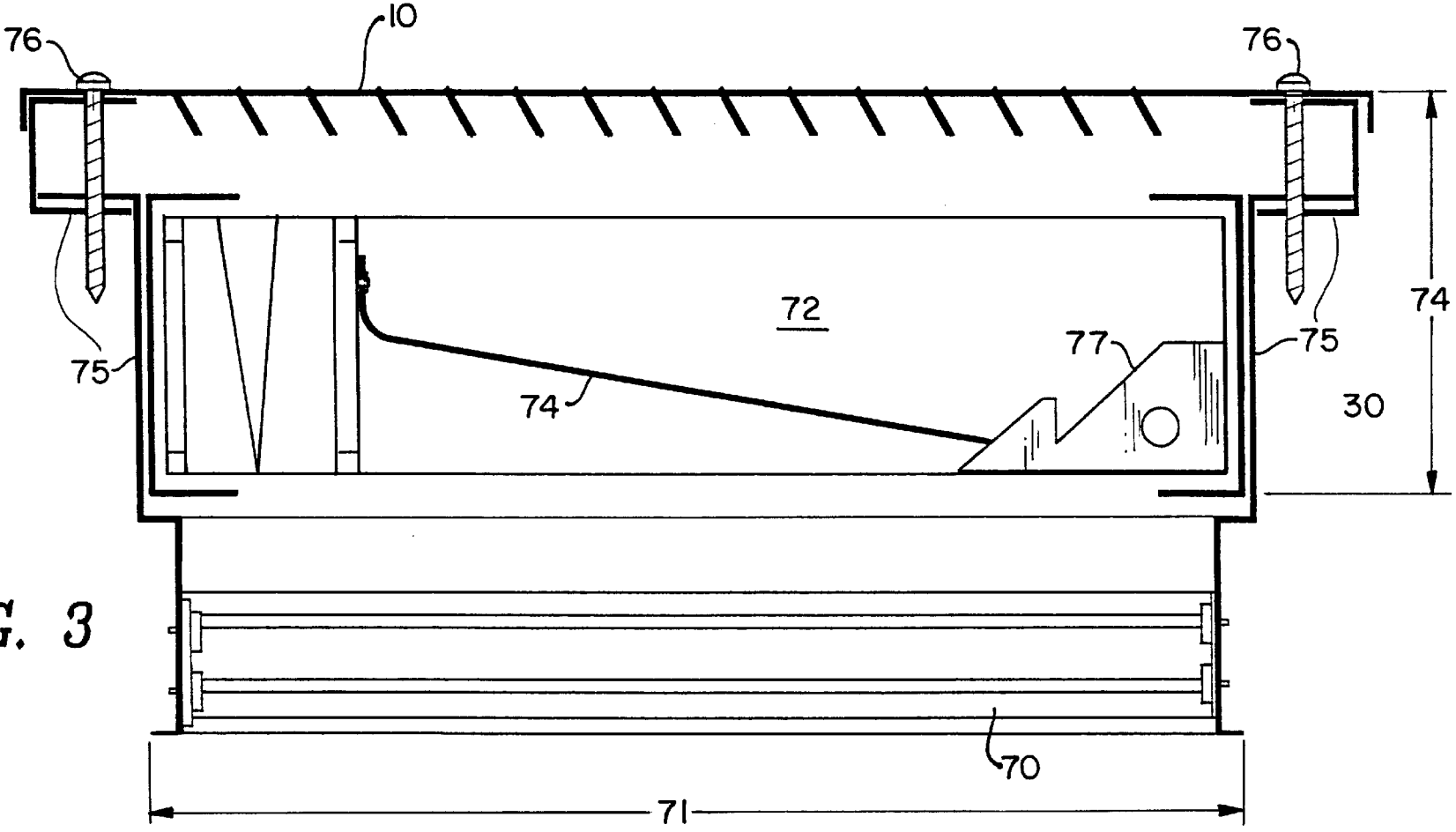
FIGS. 3 and 4 are schematic views of the fire rated wall damper of the invention for horizontal and vertical wall applications, respectively.
Figure 4:
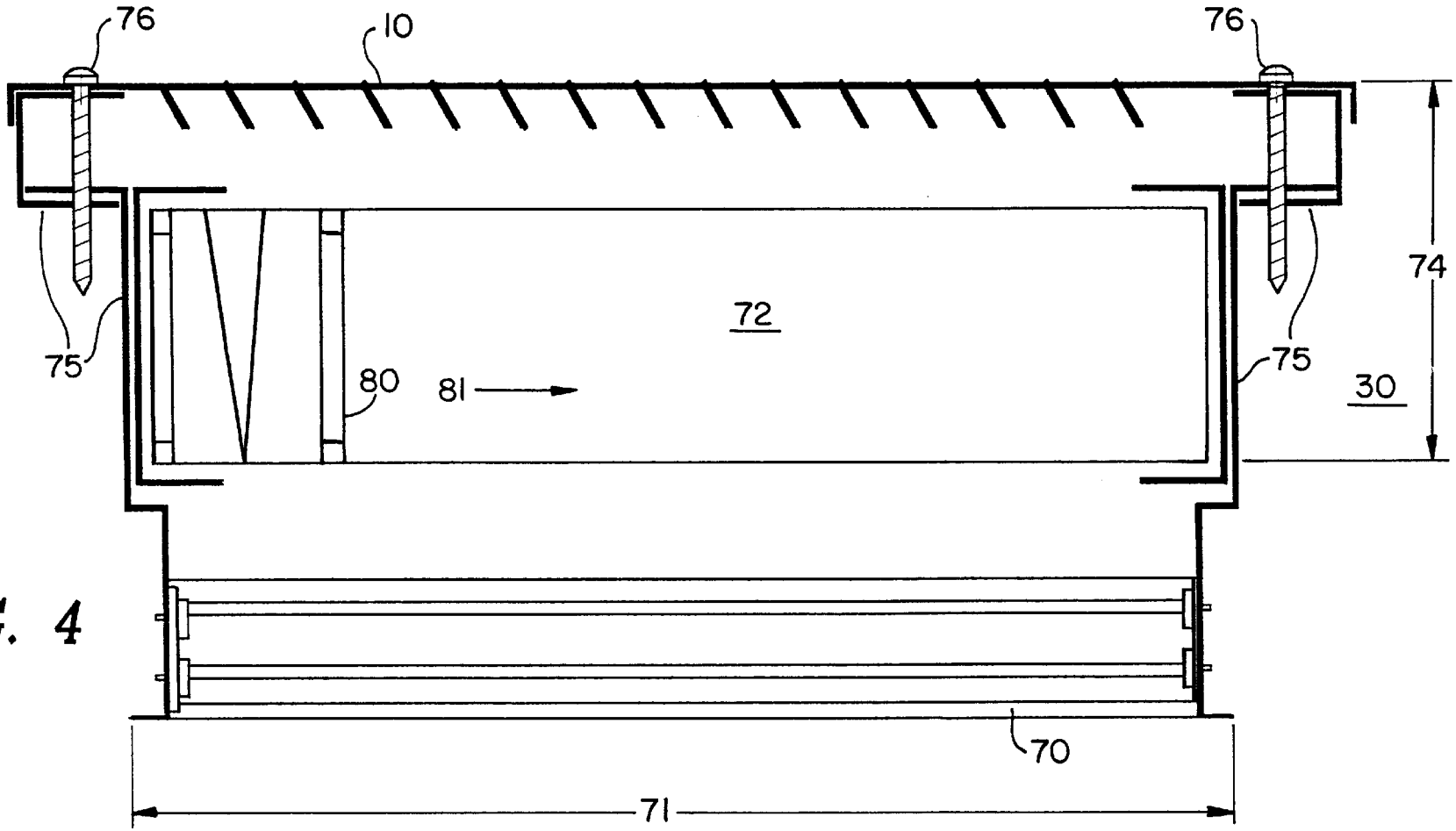

FIGS. 3 and 4 schematically show the fire rated wall damper with a slightly different orientation for the opposed blade damper, indicated at 70. When installed into a duct of nominal 3⅝" width, 71, for a 2 1/16" deep fire damper 72, an overall depth for the grill 10 with the fire damper 72 may be of the order of 2⅜", shown at 74. The flanged sleeve assembly surfaces are shown at 75, understood as being riveted to the flange surfaces of the fire damper (not shown). Reference numeral 76 identify the screws which secure the grill 10 to the front surface of the sleeve assembly 30. Reference numeral 77 in FIG. 3 represents the lock for the curtain of the fire damper 72, while reference numeral 74 schematically illustrates its stainless steel closure spring in snapping the curtain shut (FIG. 3). In FIG. 4, the curtain 80 is arranged to fall by gravity, as shown by the arrow 81 in this vertical application installation.

While there have been described what are considered to be preferred embodiments of the present invention, it will be readily appreciated by those skilled in the art that modifications may be made without departing from the scope of the teachings herein. Thus, no matter what the design may be for the register or grill diffuser, no matter what method of operation is selected for the fire damper employed, and no matter whether an opposed blade damper is employed or its specific type, were one to be selected, the teachings of the invention would continue where the sleeve assembly utilized is such as to have its front surface receiving the register or grill diffuser employed, but more importantly having its rear surface fixedly secured co-linearly with the surrounding frame of the fire damper so as to position that rear surface of the sleeve assembly substantially flat against the construction wall in which the fire rated wall damper is installed. For at least such reason, therefore, resort should be had to the claims appended hereto for a true understanding of the scope of the invention.

We claim:

1. The combination comprising:

a fire damper having a surrounding frame;

a register or grill diffuser;

a sleeve assembly having a front surface coupled to said register or grill diffuser forwardly of the fire damper and having a rear surface secured to said surrounding frame of said fire damper substantially colinearly therewith; and an opposed blade damper coupled with, and positioned rearwardly of, said surrounding frame; and wherein said sleeve assembly is of a dimension to overlie a duct opening in a construction wall, wherein said front surface of said sleeve assembly rests substantially flat upon a front surface of said construction wall, wherein said rear surface of said sleeve assembly rests substantially flat against a rear surface of said construction wall, wherein said fire damper seats wholly within said construction wall, and wherein said opposed blade damper extends outside said construction wall, behind said rear surface thereof.

2. The combination of claim 1 wherein said sleeve assembly is fire rated.

3. The improvement of claim 2 wherein said sleeve assembly is constructed of at least a 22 gauge sheet metal.

4. The improvement of claim 1 wherein said front surface of said sleeve assembly receives said register or grill diffuser by a screw securement thereto.

5. The combination of claim 1 wherein said rear surface of said sleeve assembly is fixed to said surrounding frame of said fire damper by a rivet or similar securement thereto.

6. The combination of claim 1 wherein said sleeve assembly also includes a top surface and a bottom surface respectively secured to said surrounding frame of said fire damper additionally substantially co-linearly therewith.

7. The combination of claim 6 wherein said front surface of said sleeve assembly receives said register or grill diffuser by a screw securement thereto and wherein said rear surface, said top surface and said bottom surface of said sleeve assembly are fixed to said surrounding frame of said fire damper by rivet or similar securements thereto.

* * * * *